United States Patent [19]

Echeverria

[11] Patent Number: 4,858,548

[45] Date of Patent: Aug. 22, 1989

[54] NEEDLE BAR AND FEED DRIVES FOR A ZIG-ZAG SEWING MACHINE

[75] Inventor: Fernando C. Echeverria, Eibar (Guipuzcoa), Spain

[73] Assignee: Maquinas de Coser Alfa, S.A., Eibar (Guipuzcoa), Spain

[21] Appl. No.: 1,900

[22] Filed: Jan. 9, 1987

[30] Foreign Application Priority Data

Feb. 3, 1986 [ES] Spain ..... 551,582

[51] Int. Cl.[4] ..... D05B 3/02; D05B 3/04; D05B 55/14

[52] U.S. Cl. ..... 112/443; 74/440; 112/220; 112/221

[58] Field of Search ..... 74/440; 112/111, 109, 112/221, 443, 456, 448, 220

[56] References Cited

U.S. PATENT DOCUMENTS

| | | | |
|---|---|---|---|
| 1,694,188 | 12/1928 | Lewis | 74/440 X |
| 2,803,207 | 8/1957 | Sotzky | 112/443 |
| 3,507,236 | 4/1970 | Komuro | 112/221 X |
| 3,985,087 | 10/1976 | Herr et al. | 112/443 |
| 4,191,120 | 3/1980 | Bergvall | 112/443 |
| 4,398,481 | 8/1983 | Gustavsson | 112/443 |
| 4,501,213 | 2/1985 | Meier | 112/443 X |
| 4,638,752 | 1/1987 | Hartwig | 112/221 X |
| 4,641,593 | 2/1987 | Echavarria | 112/443 |

FOREIGN PATENT DOCUMENTS

| | | | |
|---|---|---|---|
| 60-12096 | 1/1985 | Japan | 112/221 |

*Primary Examiner*—Andrew M. Falik

*Attorney, Agent, or Firm*—Mason, Fenwick & Lawrence

[57] ABSTRACT

A sewing machine is with stepper motors which work alternately in one direction or another to greatly reduce the number of parts for achieving the movement desired in the internal mechanisms of zig-zag sewing machines. The zig-zag mechanism for moving the sewing needle consists of a single, main driving element, formed by a stepper motor. The mechanism has a radial cogged spur gear at its outlet which engages a rack or linear gear formed by two adjoining bodies each having meshing teeth that engage the spur gear to eliminate any play between the spur gear and the two rack bodies. The rack is connected to a lever mechanism including an elongated, cambered,—shaped lever with a curved end. The curved end of the lever is connected to a needle bar support which is pivotally connected at its upper end to the sewing machine. A needle bar is connected to the needle bar support to enable the lever mechanism to impart a to and fro rocking motion to the needle.

8 Claims, 2 Drawing Sheets

NEEDLE BAR AND FEED DRIVES FOR A ZIG-ZAG SEWING MACHINE

BACKGROUND OF THE INVENTION

The present application concerns an improved sewing machine, or, to be more specific, an improvement in the zig-zag mechanisms of the needle shaft and in the carriage or conveyance mechanism of the sewing machine.

Research has been conducted with the aim of improving mechanisms for sewing machines in order to greatly simplify their design by eliminating parts which prove to be unnecessary in the long run and create countless service problems, both with regard to their mechanical processing and operation, leading to unending maintenance work and many spare parts, which must be kept in stock. Thus, the primary object of the present invention is to provide a new and improved zig-zag sewing machine having fewer parts and improved durability.

SUMMARY OF THE INVENTION

The present invention in a preferred embodiment comprises a sewing machine provided with step by step (stepper) motors which work alternately in one direction or another to greatly reduce the number of parts for achieving the movement desired in the internal mechanisms of zig-zag sewing machines.

The zig-zag mechanism for moving the sewing needle consists of a single, main driving element, formed by a stepper motor. The mechanism has a radial cogged spur gear at its outlet which engages a rack or linear gear and has the peculiarity of being formed by two adjoining bodies. As will be seen, this construction provides two elementary racks designed so as to achieve a meshing cog of greater width. This width is designed in a particular way so that, when the release pinion of the stepper motor is engaged, play exists in its meshing, as is normal with this type of coupling; however, this play is eliminated by separating one element of the rack from the other, with the cogs of each shifting and joining the tooth cutting faces of the driving pinion. In this way, the need for regulating springs or complicated systems to prevent play is avoided.

Furthermore, this rack is provided with two longitudinal grooves, separated from each other, with small shafts or fixed rods being placed along the grooves to enable the rack to slide along them during the normal reciprocating motion of the rack.

The aforementioned rack imparts its motion to a perpendicular component which is connected at the center near the bottom and has an appendage at the end on which a cambered double lever is connected at the center; this comprises two levels and shifts alternately to-and-fro. It is connected at its curved front end to the center of the needle bar support, which in turn is connected in such a way that it turns at its upper end through pivotal connection to the sewing machine. This holds the needle of the sewing machine. The needle bar support is connected to a needle bar. Therefore when the machine has to move in a zig-zag pattern to sew a particular stitch, it is sufficient for the stepper motor to turn at a greater or lesser angle, in one or several stages, thus accomplishing a great many stitches or sewing modes according to the program available in the machine.

The second mechanism incorporated in the sewing machine concerns a means for feeding or carriage, that is also driven by a stepper motor which shifts a rack or linear gear by moving alternately in one direction or the other. The stepper motor is provided with a radial cogged spur gear on its outlet axle, which engages the rack or linear gear, comprising two similar superimposed elements, so as to allow for a cog of greater width and better meshing capabilities, thus avoiding play in the coupling of the rack with the release pinion of the stepper motor, due to one part of the rack being separate from the other. In this way, the cogs of the rack adapt to the tooth faces of the pinion, thus avoiding all possible play, with consequent savings on regulating elements or springs that are usually present in these cases for achieving the same effect.

The aforementioned rack is supplied with two separate longitudinal grooves, to which are fixed the guide rods of the rack. An elementary part is connected to the end of the rack, and the end of this part is fitted to the center of a bearing in such a way that the rack, when effecting its normal to-and-fro motion, imparts a continuous rocking motion around its central axle to such bearing.

A bush or like element is fitted in such a way that it slides over the bearing and turns on an appendage included for such purpose in the center of the vertical arm of the mechanism in question. This part has a triangular rabbet on its upper end in which the recuperative spring and support for the aforementioned vertical arm are to be attached to the cam. By shifting eccentrically to a greater or lesser degree, the cam enables the bush to be shifted eccentrically to a greater or lesser extent with respect to the bearing. The lower end of the vertical arm is provided with a fixed rod to which is attached, by means of a revolving joint to, a connection piece with an orifice on its edge that is slotted at one end. When a shaft is placed inside this and one of its edges pushed against the other, the slot enables this internal shaft, devised for this purpose, to be tightened.

DESCRIPTION OF THE PREFERRED EMBODIMENT

Figure 1:
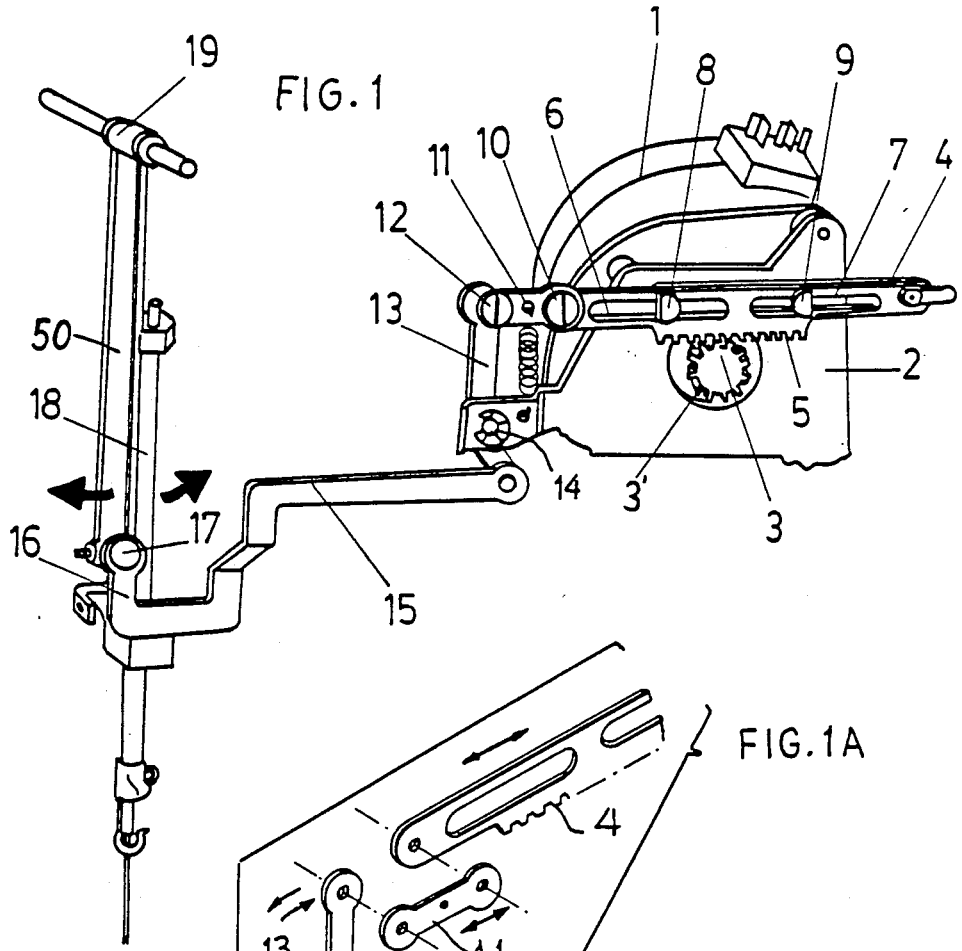
FIG. 1 is a perspective view of the preferred embodiment zig-zag mechanism of the needle bar.
Figure 1A:
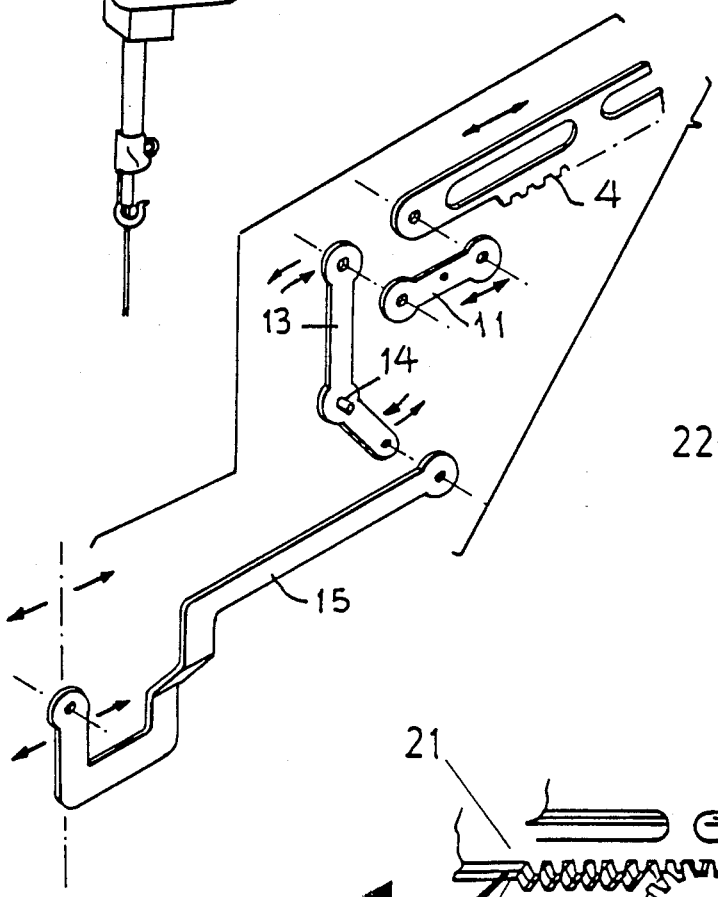
FIG. 1A is an exploded view of a portion of the mechanism of FIG. 1.

FIG. 1 illustrates the zig-zag mechanism of the needle bar, showing the driving motor of mechanism 1, which comprises a stepping motor that is fixedly attached to the fixed support 2 which, in turn, is internally connected to the body of the sewing machine. At the outlet axle of the stepper motor there is a spur gear or pinion 3 with radial cogs arranged throughout its entire circumference. Spur gear 3 engages a rack 4 having cogs 5, enabling stepping motor 1 to reciprocate the rack to cause the mechanism to function. This rack is composed of two similar parallel bodies, so formed to prevent play in its coupling with gear 3. At the center of this rack 4, there are two longitudinal grooves 6 and 7, duly separated from each other in which are situated support rods 8 and 9 which are firmly fixed to the support 2 and act as guides for the rack 4 during its to and fro motion. The rack 4 is connected at its front end in a revolving joint 10 to an intermediate element 11, which in turn is connected at point 12 to the vertical component of a pivot lever 13. Pivot lever 13 is connected at its center by means of a revolving pivot 14. The movement of the stepper motor and the rack causes pivot lever 13 to rock from side to side, in such a way that the lower end of part 13 links up with the intermediate element 15, to which it is able to impart a rocking motion to one side or another. This part 15 has a cambered double shape, its curved end finishing in a doublet 16 that is connected by a pin 17 to a needle bar support so, which is in turn connected to the needle bar 18, as shown in my U.S. Pat. No. 4,641,593, to which it is able to impart a rocking motion to one side or another. Since needle bar support 50 is articulated at its upper end 19, as also shown in my U.S. Pat. No. 4,641,593 the rocking motion is effected to a greater or lesser degree according to the shift in the rack, or the operations of the stepper motor 1. Thus, the different sewing stitches and modes to be accomplished with the aforementioned machine are produced by combining this zig-zag movement with the downward shift of the needle.

Figure 2A:
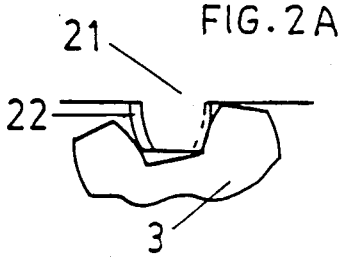
FIG. 2A is an enlarged illustration of the no play connection of the pinion with the rack.
Figure 2:
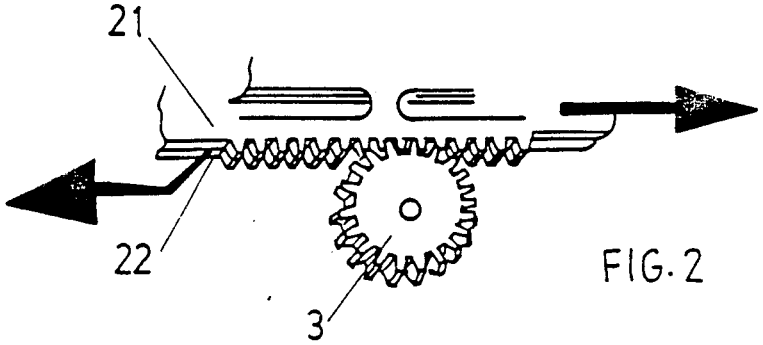
FIG. 2 is a perspective view of the pinion of the stepper motor, together with the feed rack engaged with the pinion.

FIG. 2 illustrates the coupling of the pinion 3 of the stepper motor 20, which shifts the feed rack from side to side. This rack consists of two adjoining elementary rack parts 21 and 22, each of which has cogs which coincide with each other. By longitudinally displacing one of the rack parts 21 from the other, it is possible to separate the adjoining rack cogs, which adapt to the tooth cutting faces of the spur gear 20, as can be seen in FIG. 2A which is a close-up of the meshing pinion and racks. The same cog from either of the racks is adaptable to both tooth faces of the pinion 3 due to the separation of both parts 21 and 22.

Figure 3:
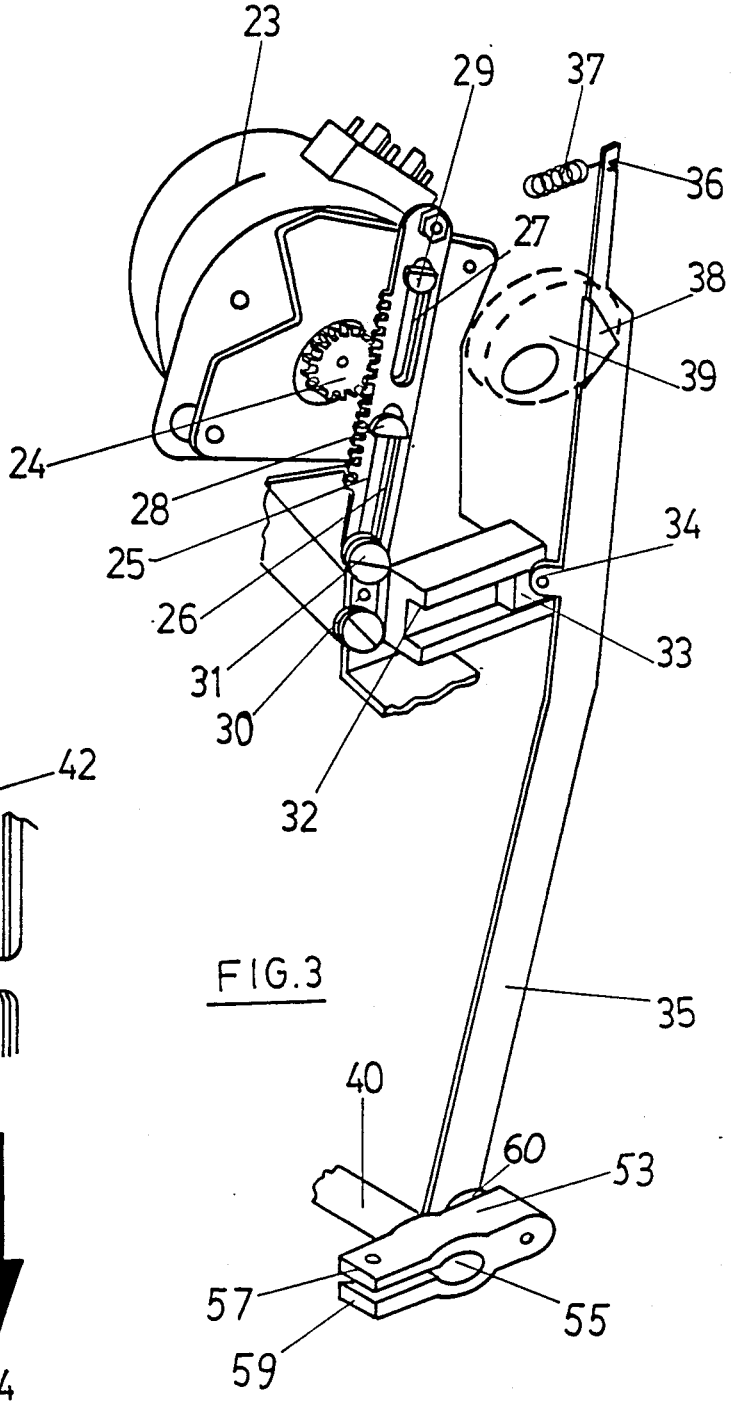
FIG. 3 is a perspective view of the driving mechanism of the carriage element in the preferred embodiment sewing machine.

FIG. 3 illustrates the carriage driving mechanism in the sewing machine. This mechanism is also operated by a stepper motor 23, with a radial cogged spur gear 24 at the end, which is meshed with the teeth of a rack 25. This rack consists of two adjoining elementary rack parts 42, 43, the longitudinal separation of which enables either cog from both adjoining racks to move towards the tooth faces of the driving pinion 24 of the stepper motor 23, thus avoiding in this simple way the need to include springs or other elements which prevent play in the gears. The rack 25 has two longitudinal grooves 26 and 27 in which rack guide means 28 and 29 extend to support the rack for reciprocation. This rack is fixed in place by means of a lower element along a revolving rod 31, with the former part moving towards the guide 32, connected to the center. The bush 33 slides along the inside of this guide and is connected in a revolving joint to appendage 34 of the vertical link element on part 35. This part has an upper rabbet 36 to which a tension spring 37 is fixed, keeping the aforementioned part in place by means of a follower 38 which is mounted on the vertical element 35 and which is urged against cam 39. When turning, follower 38 as guided by cam 39 causes link element 35 to shift towards one of its sides, so that the bush 33 can slide along the guide 32 thus allowing part 35, to move quite noticeably. Part 35 has a part in the form of a clamp 53 on its lower edge connected by means of a rod 60 on which it slides, with its end being separated in two parts 57 and 59, forming an opening 55, inside of which a lower arm 40 is positioned, for moving the carriage element situated below the needle and which is drivingly connected to arm 40.

Figure 4:
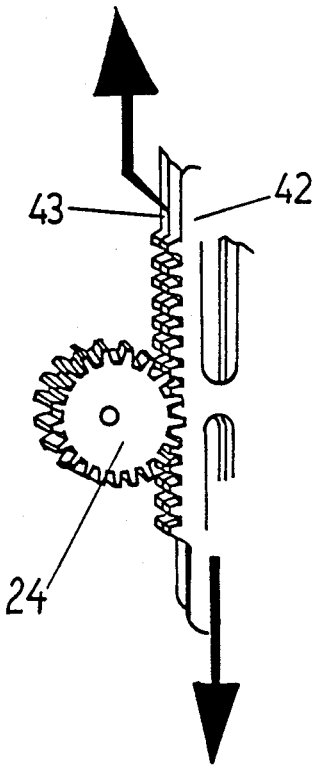
FIG. 4 shows the pinion of the stepper driving motor of the carriage mechanism together with its rack and regulation.

FIG. 4 illustrates a more detailed view of the coupling between the cylindrical pinion 24, mounted on the end of an output shaft of a stepper motor, and meshing with a rack consisting of two elementary rack parts 42 and 43, which on account of their longitudinal separation enable the cogs of the two racks to mesh with the teeth of the driving pinion 24 of the stepper motor. This construction eliminates the need of using springs or other elements to regulate play between the rack and the pinion which in the long run leads to a greater number of break-downs.

From the descriptions of the preferred embodiments of the sewing machine, it becomes clear that the various embodiments have fewer parts, which can break down. Another advantage that has obviously been achieved with the zig-zag mechanism of the needle is that the needle is prevented from shifting to the left or right, as happens with all currently available sewing machines, since the needle does not move, owing to the fact that the shaft 15 is connected to part 13, and its slewing point 14 is located at a short distance. This means that great pressure would have to be exerted on the needle, which would only result in breaking the needle, before shifting the rack 4 and the stepper motor 1.

Having described the preferred embodiments of the present invention, it should be pointed out that a number of equally protected variations in detail affecting the whole unit or its integral parts, may be introduced in the basic invention, and that any of the parts may be selected for this purpose, and any means chosen to construct the system, and likewise any other modifications deemed necessary.

I claim:

1. In a sewing machine using a needle, a means for driving a zig-zag mechanism and a feed carriage mechanism, wherein said zig-zag mechanism includes a needle bar and a needle bar support connected to said needle bar and having an upper end, said needle bar support being pivotally connected at said upper end to the sewing machine, and the means for driving comprising:

a rack;

a stepper motor connected to said rack to move said rack in a to and fro motion;

lever means connected to said rack for imparting to the needle a to and fro rocking motion so as to achieve a zig-zag motion of the needle, said lever means including an elongated cambered double-shaped lever with a curved end;

said double shaped lever being connected at said curved end to said needle bar support, whereby said lever means imparts to the needle a to and fro rocking motion so as to achieve a zig-zag motion of the needle.

2. The means for driving according to claim 1, further comprising two fixed rods and wherein said rack comprises two elongated flat parts, each of said parts including a plurality of cogs and two correlative grooves supported by said two fixed rods to allow said rack to move in said to and fro motion along said rods.

3. The means for driving according to claim 1, further comprising a pinion having tooth faces, said pinion being driven by said stepper motor, and wherein said rack comprises two adjacent parts, said parts being separated relative to each other, each of said parts having cogs which mesh with said tooth faces of said pinion to avoid the play existing between said pinion and said rack.

4. The means for driving according to claim 1 comprising a second stepper motor to drive said carriage mechanism, and an elongated guide having an inside surface and a bush gliding along said surface, said carriage driving means further including a second rack, said second rack having an end connected to said elongated guide, and a vertical link included on said carriage driving means, with said link connected to said bush.

5. The means for driving according to claim 4, further comprising an eccentric cam and a spring, wherein said vertical link is anchored at the top by said spring, which keeps said driving shaft adjacent to said eccentric cam, said cam enabling said bush to move along said guide for achieving movement of said vertical link.

6. The means for driving according to claim 4, further comprising two fixed rods, and wherein said rack comprises two adjacent flat parts rabbeted inside to form two correlative grooves, said grooves being supported by said two gixed rods to allow said rack to move therealong.

7. The means for driving according to claim 4, further comprising a pinion having tooth faces, said pinion being driven by said second stepper motor, and wherein said rack comprises two adjacent parts, said parts being separated relative to each other, whereby the existence of play with said pinion of said stepper motor is prevented, each of said parts having cogs which mesh with said tooth faces of said pinion, whereby the play existing between said pinion and said rack is avoided.

8. In a sewing machine using a needle, zig zag mechanism and a driving means therefor, said mechanism including a needle bar and a needle bar support connected to said needle bar and having an upper end, said needle bar support being pivotally connected at said upper end to the sewing machine, and the means for driving comprising:

a rack;

a stepper motor connected to said rack to move said rack in a to and fro motion;

lever means connected to said rack for imparting to the needle a to and fro rocking motion so as to achieve a zig-zag motion of the needle, said lever means including an elongated cambered double-shaped lever with a curved end and a pivot lever lined to said double-shaped lever;

said double shaped lever being connected at said curved end to said needle bar support, whereby said lever means imparts to the needle a to and fro rocking motion so as to achieve a zig-zag motion of the needle.

* * * * *